US005372442A

United States Patent [19]

Wang

[11] Patent Number: 5,372,442

[45] Date of Patent: Dec. 13, 1994

[54] KEY STRUCTURE FOR COMPUTER KEYBOARDS

[76] Inventor: Kun-Chu Wang, No. 14, Alley 19, Lane 318, Sec. 1, Chung Yang Rd., Tu Cheng City, Taipei Hsien, Taiwan, Prov. of China

[21] Appl. No.: 118,250

[22] Filed: Sep. 9, 1993

[51] Int. Cl.[5] ..... B41J 5/16

[52] U.S. Cl. ..... 400/490; 400/491.2; 400/495; 400/472; 200/345; 200/341

[58] Field of Search ..... 200/5 A, 341, 345, 284, 200/292; 400/490, 491.2, 491.3, 495, 495.1, 472

[56] References Cited

U.S. PATENT DOCUMENTS

| | | | |
|---|---|---|---|
| 4,935,591 | 6/1990 | Kaneko | 200/341 |
| 4,939,327 | 7/1990 | Wu et al. | 200/341 |
| 4,942,276 | 7/1990 | Kato | 200/341 |
| 5,263,783 | 11/1993 | Wu | 400/490 |

*Primary Examiner*—Edgar S. Burr
*Assistant Examiner*—Lynn D. Hendrickson
*Attorney, Agent, or Firm*—Bacon & Thomas

[57] ABSTRACT

A key unit includes a key a hollow housing securely mounted on a base frame of a computer keyboard, an actuating member, and a spring member. The hollow housing includes a top wall with an opening, a first pair of opposed side walls, and a second pair of opposed side walls. A vertical track is formed in each of inner surface of the first pair of opposed side walls. A resounding plate is mounted on an inner surface of one of the second pair of opposed side walls. The actuating member includes an upper column which extends through the opening in the housing and is adapted to engage with the key. An extension projects outward from each of two opposed sides of the upper column for engaging with the associated vertical track in the housing. The spring member includes an axle which is pivotally mounted between the first pair of opposed side walls and first and second arcuate members projecting outward from the axle and extending away from each other. The first arcuate member includes a distal activating end for impinging on a corresponding contact on the base frame of the keyboard. The second arcuate member is elastic and includes a bent section for impinging on the resounding member and a distal actuated end which is actuatable by the actuating member.

4 Claims, 5 Drawing Sheets

PR10R ART

KEY STRUCTURE FOR COMPUTER KEYBOARDS

BACKGROUND OF THE INVENTION

1. Field of the Invention

The present invention relates to an improved key unit for computer keyboards.

2. Description of related art

A computer keyboard user generally judges if a character is effectively inputted by listening to whether or not a click is generated from each impingement on one of the key unit of the keyboard. It is, however, found that in some cases the character is not inputted even though a click is heard. This is because of an improper structure design of the keyboard. The present invention intends to provide an improved key unit to obviate this problem.

SUMMARY OF THE INVENTION

The key unit provided by the present invention includes a hollow housing securely mounted on a base frame of a computer keyboard, an actuating member which passes through the housing, and a spring means. The housing includes a top wall with an opening, first pair of opposed side walls, and second pair of opposed side walls. A vertical track and a bore are formed in each inner surface of the first pair of opposed side walls. A cutout is formed in one of the second pair of opposed side walls, and a resounding plate is mounted on an inner surface of the other one of the second pair of opposed side walls.

The actuating member includes an upper rectangular hollow column with a rectangular hole for engaging with a key on which the user's finger may press for operation. An extension projects outward from each of two opposed sides of the bottom of the hollow column for engaging with the associated vertical track in the housing. Two legs project downwardly from each of the extensions, each having a height approximately the same as that of the compressed spring means.

The spring means is formed of a metallic plate and includes an axle which is pivotally received in the bores in the housing and first and second arcuate members projecting outward from the axle and extending away from each other. The first arcuate member includes a distal activating end for impinging on a corresponding contact on the base frame of the keyboard. The second arcuate member is elastic and includes a bent section and a distal actuated end.

When the user presses the key which is securely mounted to the upper end of the column of the actuating member, the actuating member moves downward to exert a downward force on and thus deform the distal actuated end of the spring means. Further downward movement of the actuating member urges the first and second arcuate members to pivot about the axle, in which the distal activating end impinges on the contact, thereby sending out a specific signal, while the bent section impinges on the resounding member, thereby generating a click. This provides a reliable operation as generation of the click is simultaneous to the impingement on the contact. Provision of the legs prevents excessive downward movement of the actuating member. When the downward pressing force from a finger disappears, the elastic arcuate member returns the elements back to their original positions.

Other objects, advantages, and novel features of the invention will become more apparent from the following detailed description when taken in conjunction with the accompanying drawings.

DESCRIPTION OF THE PREFERRED EMBODIMENT

Figure 6:
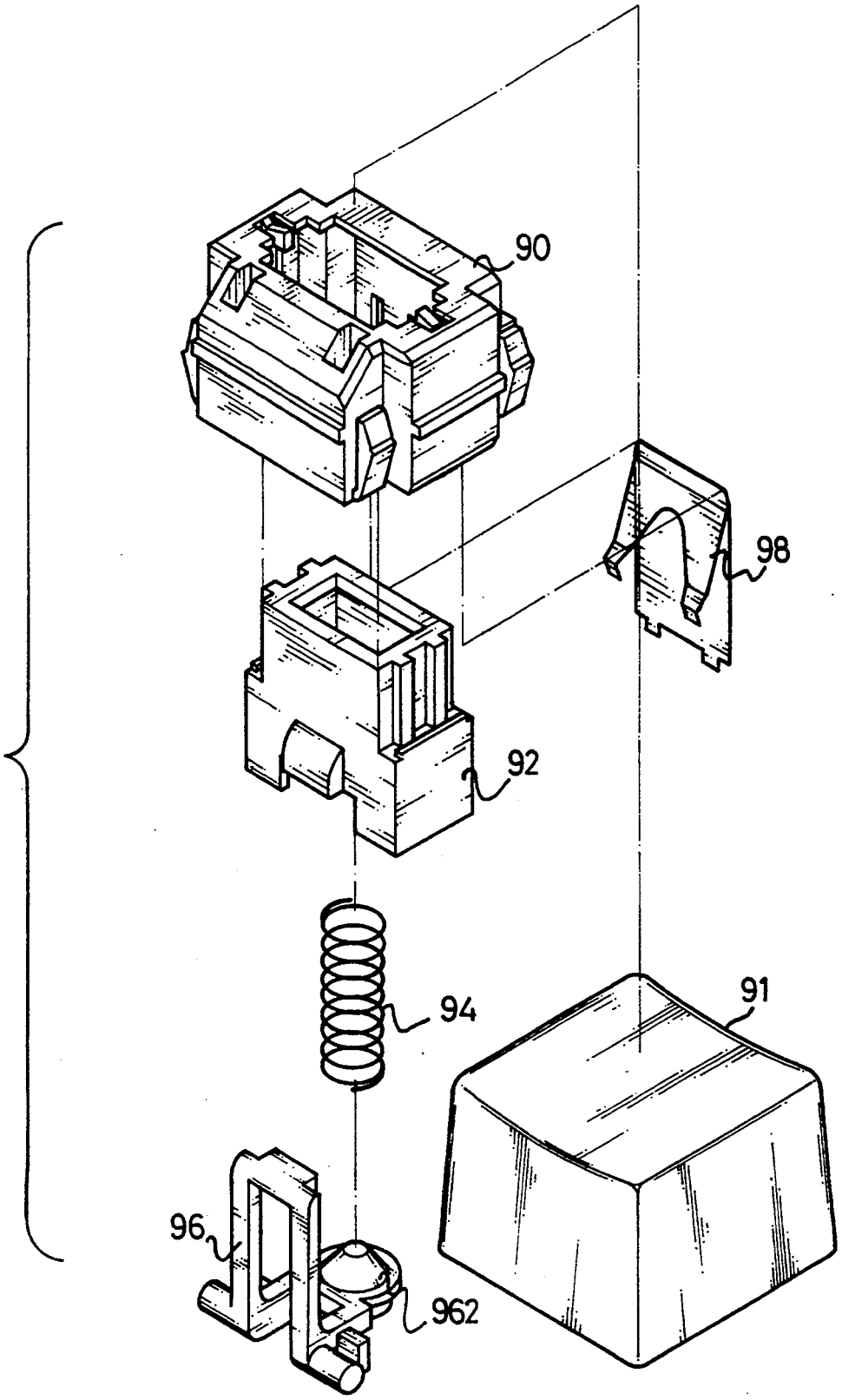
FIG. 6 is an exploded view of a prior art computer key unit.
Figure 7:
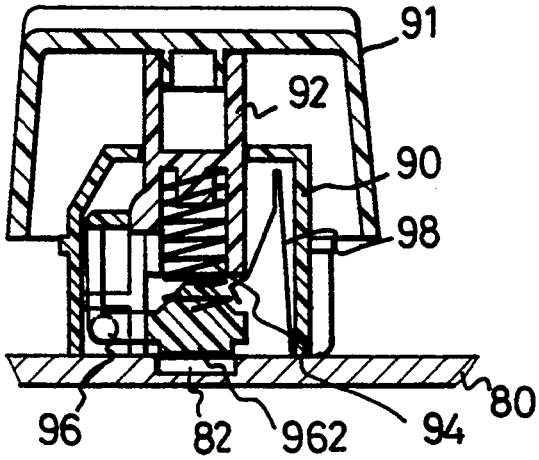
FIG.7 PRIOR ART
FIGS. 7 and 8 are cross-sectional views illustrating operation of the prior art computer key unit.
Figure 8:
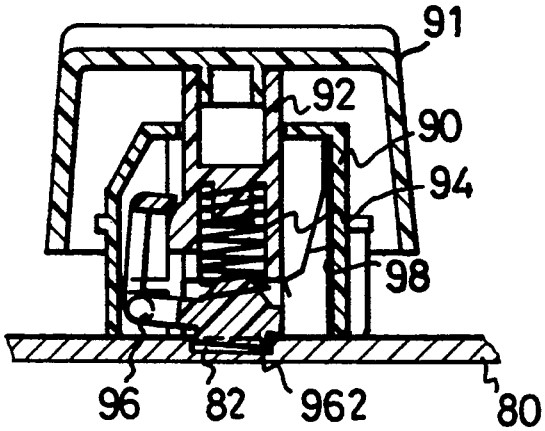
FIG.8 PRIOR ART

For a better understanding of the background of the present invention, reference is firstly made to FIGS. 6 through 8 in which a prior art key unit of a computer keyboard is shown. The conventional key unit includes a key 91 a housing 90 securely mounted on a base frame 80 of a computer keyboard, an actuating member 92 which passes through the housing 90, an activating member 96 in the housing 90 with an activating part 962 thereof located above a contact 82 on the base frame 80, a coil spring 94 mounted between the actuating member 92 and the activating part 962, and a metallic leaf spring 98. When the user presses key 91 which is securely mounted to the upper end of the actuating member 92, the actuating member 92 moves downward to compress the coil spring 94 which, in turn, urges the activating part 962 downward to impinge the contact 82, thereby sending out a signal. When the downward pressing force from a finger disappears, the coil spring 94 returns the elements back to their original positions.

During the downward travel of the actuating member 92, the leaf spring 98 is deformed and impinges on an inner wall of the housing 90 (as shown in FIG. 8) and thus generates a "click." The user generally judges if a character is effectively inputted by listening to whether or not a click is generated from each impingement on one of the key units of the keyboard. It is, however, found that sometimes the pressing force is only sufficient to generate the "click" yet not great enough to urge the activating part 962 to effectively impinge on the contact 82. Further drawbacks of the conventional key unit are: too many elements involved, too complicated to manufacture, high manufacturing cost, high labor, and not easy to maintain. The present invention intends to provide an improved keyboard design to mitigate and/or obviate the above problems.

Figure 1:
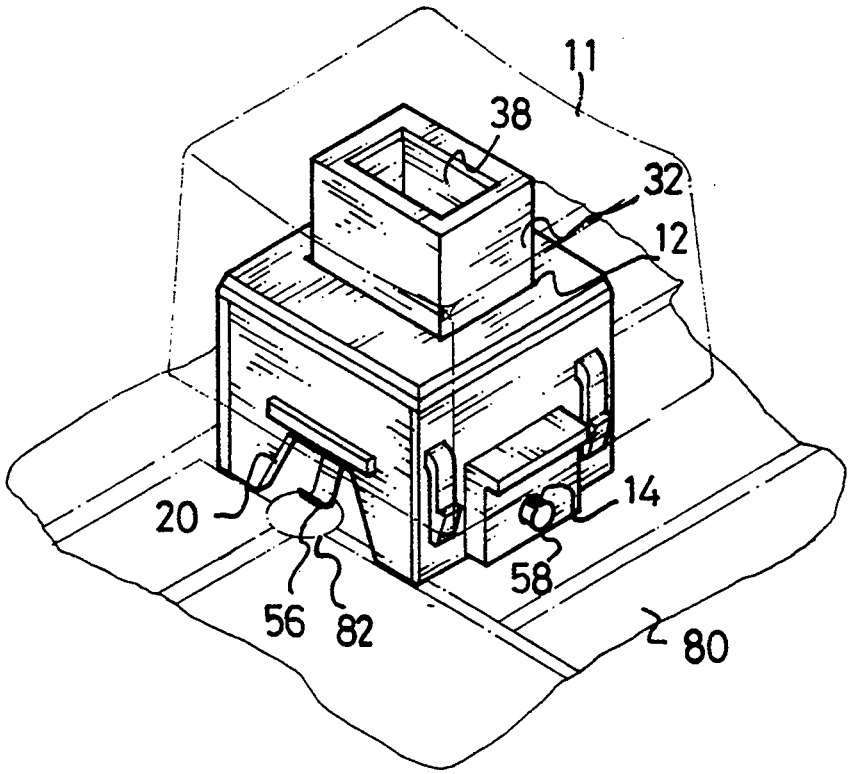
FIG. 1 is a perspective view of a key unit in accordance with the present invention mounted on a base frame of a keyboard.
Figure 2:
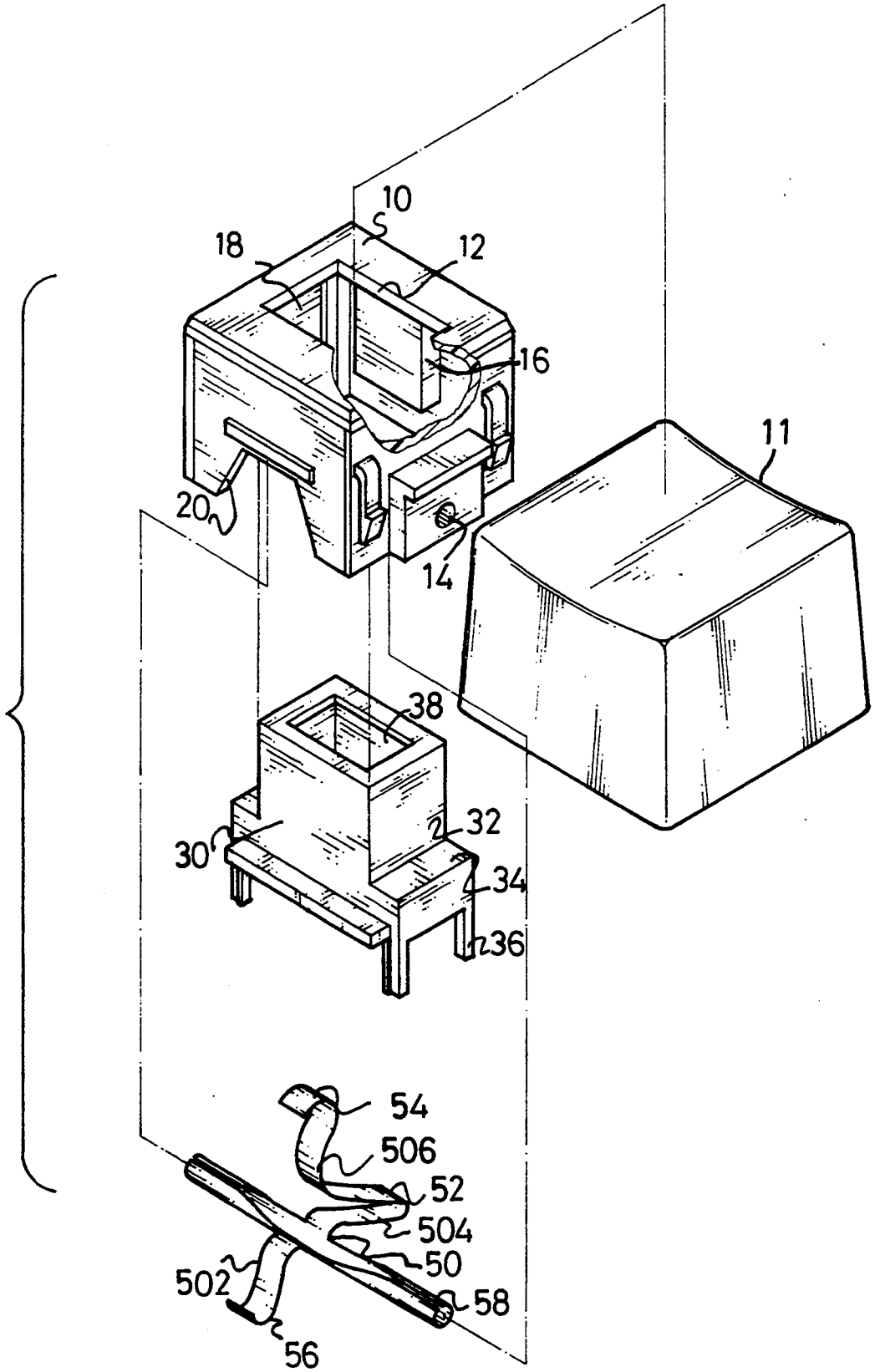
FIG. 2 is an exploded view of the key unit in accordance with the present invention.
Figure 3:
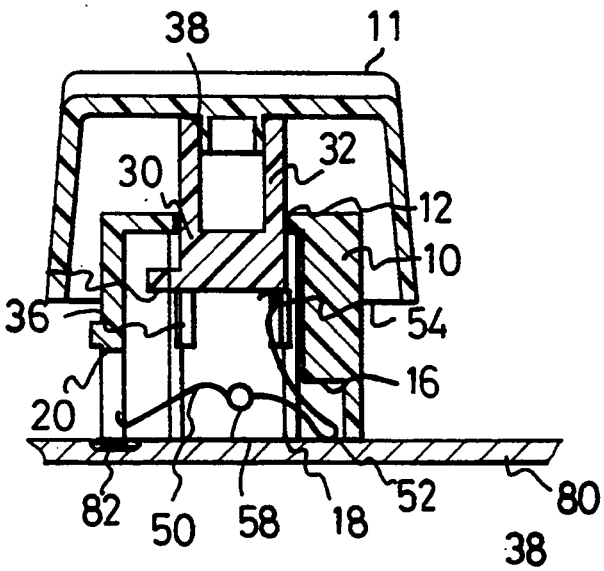
FIGS. 3 through 5 are cross-sectional views illustrating operation of the key unit.

Referring now to FIGS. 1 through 3, the key unit in accordance with the present invention includes a key 11 a hollow housing 10 securely mounted on a base frame 80 of a computer keyboard, an actuating member 30 which passes through the housing 10, and a spring means 50 The housing 10 includes a top wall with an opening 12, first pair of opposed side walls, and second pair of opposed side walls. As shown in FIG. 2, a vertical track 18 and a bore 14 are formed in each inner surface of the first pair of opposed side walls. A cutout 20 is formed in one of the second pair of opposed side walls, and a substantially rectangular resounding plate 16 is mounted on an inner surface of the other one of the second pair of opposed side walls.

The actuating member 30 includes an upper rectangular hollow column 32 with a rectangular hole 38 for engaging with the key 11 on which the user's finger may press for operation. An extension 34 projects outward from each of two opposed sides of the bottom of the hollow column 32 for engaging with the associated vertical tracks 18 in the housing 10. Two legs 36 project downwardly from each of the extensions 34, each having a height approximately the same as that of the compressed spring means 50.

The spring means 50 is formed of a metallic plate and includes an axle 58 which is pivotally received in the bores 14 in the housing 10 and first and second arcuate members 502 and 504 projecting outward from the axle 58 and extending away from each other. The first arcuate member 502 includes a distal activating end 56 for impinging on a corresponding contact 82 on the base frame 80 of the keyboard. The second arcuate member 504 is elastic and includes a bent section 52, a transition section 506, and a distal actuated end 54.

Figure 4:
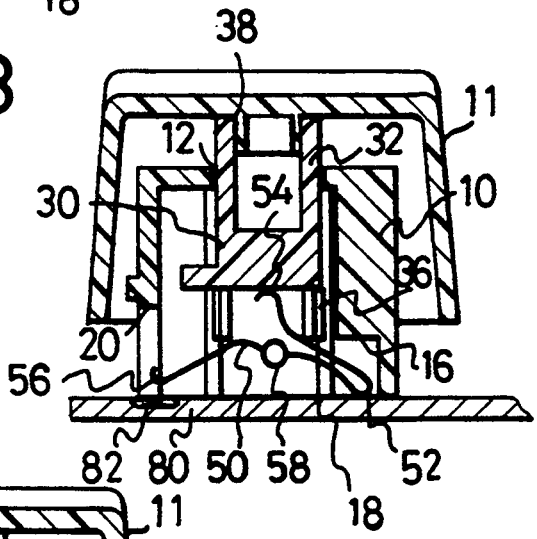
Figure 5:
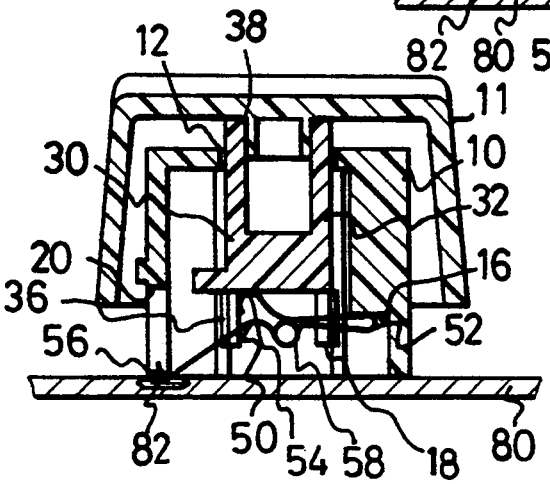

The key unit shown in FIG. 3 is unpressed. When the user presses the key 11 which is securely mounted to the upper end of the column 32 of the actuating member 30, the actuating member 30 moves downward to exert a downward force on and thus deform the distal actuated end 54 of the spring means 50 to a status shown in FIG. 4. Further downward movement of the actuating member 30 urges the first and second arcuate members 502 and 504 to pivot about the axle 58, as shown in FIG. 5, in which the distal activating end 56 impinges on the contact 82, thereby sending out a specific signal, while the bent section 52 impinges on the resounding member 16, thereby generating a click. This provides a reliable operation as generation of the click is simultaneous to the impingement on the contact 82. Provision of the legs 36 prevents excessive downward movement of the actuating member 30 which may damage the contact 82. Provision of the cutout 20 allows smooth operation of the distal activating end 56. When the downward pressing force from a finger disappears, the elastic arcuate member 504 returns the elements back to their original positions.

According to the above description, it is understood that the present design is simple in structure as only having three elements and accordingly having many advantages, such as easy to maintain, low manufacturing cost, and reliable operation.

Although the invention has been explained in relation to its preferred embodiment, it is to be understood that many other possible modifications and variations can be made without departing from the spirit and scope of the invention as hereinafter claimed.

I claim:

1. A key unit for mounting to a base frame of a computer keyboard, the key unit comprising:

a key (11), a hollow housing (10) securely mounted on a base frame (80) of a computer keyboard, a vertical track means (18) and a resounding plate (16) being mounted in an inner surface of said first pair of opposed side walls;

an actuating member (30) in said housing, comprising an upper column (32) which extends through said housing and is adapted to engage with the key (11), said actuating member being slidable along said vertical track means (18); and a spring means (50) in said housing, comprising an axle (58) which is pivotally mounted to said housing and first and second arcuate members (502 and 504) projecting outward from said axle (58) and extending away from each other, said first arcuate member (502) including a distal activating end (56) for impinging on a corresponding contact (82) on the base frame (80) of the keyboard, said second arcuate member (504) being elastic and including a bent section (52) and a distal actuated end (54);

whereby when pressing on the key 11 mounted on said actuating member, said actuating member moves downward to exert a downward force on the distal actuated end of the spring means and causes said first and second arcuate members (502 and 504) to pivot about said axle (58) such that impingement of said bent section on said resounding member is simultaneous to the impingement of said distal activating end on said contact.

2. A key unit for mounting to a base frame of a computer keyboard, the key unit comprising:

a key (11), a hollow housing (10) securely mounted on a base frame (80) of a computer keyboard, said hollow housing comprising a top wall with an opening (12), a first pair of opposed side walls, and a second pair of opposed side walls, a vertical track (18) being formed on an inner surface of each of said first pair of opposed side walls, and a resounding plate (16) being mounted on an inner surface of one of said second pair of opposed side walls;

an actuating member (30) in said housing (10), said actuating member comprising an upper column (32) which passes through said opening (12) and is adapted to engage with the key (11 ), an extension (34) projecting outward from each of two opposed sides of said column (32) for engaging with associated said vertical track (18) in said housing (10); and a spring means (50) comprising an axle (58) which is pivotally mounted between said first pair of opposed side walls and first and second arcuate members (502 and 504) projecting outward from said axle (58) and extending away from each other, said first arcuate member (502) including a distal activating end (56) for impinging on a corresponding contact (82) on the base frame (80) of the keyboard, said second arcuate member (504) being elastic and including a bent section (52 and a distal actuated end (54);

whereby when pressing on the key (11 ) mounted on said actuating member, said actuating member moves downward to exert a downward force on the distal actuated end of the spring means and causes said first and second arcuate members (502 and 504) to pivot about said axle (58) such that impingement of said bent section on said resounding member is simultaneous to the impingement of said distal activating end on said contact.

3. The key unit as claimed in claim 2 wherein a cutout (20) is formed in the other one of the second pair of opposed side walls.

4. The key unit as claimed in claim 2 wherein a plurality of legs (36) project downwardly from each of said extensions, each leg (36) having a height approximately the same as that of the compressed spring means (50).

* * * * *